US012023545B2

(12) United States Patent
Kinney

(10) Patent No.: US 12,023,545 B2
(45) Date of Patent: Jul. 2, 2024

(54) EXERCISE BAR WITH DYNAMICALLY ROTATING HAND GRIPS

(71) Applicant: Resistance in Rotation Corporation, Peru, IN (US)

(72) Inventor: Joseph G. Kinney, Kokomo, IN (US)

(73) Assignee: Resistance in Rotation Corp., Peru, IN (US)

( * ) Notice: Subject to any disclaimer, the term of this patent is extended or adjusted under 35 U.S.C. 154(b) by 212 days.

(21) Appl. No.: 17/655,412

(22) Filed: Mar. 18, 2022

(65) Prior Publication Data

US 2022/0273980 A1 Sep. 1, 2022

Related U.S. Application Data

(63) Continuation-in-part of application No. 17/188,654, filed on Mar. 1, 2021, now Pat. No. 11,504,572.

(51) Int. Cl.
*A63B 21/00* (2006.01)
*A63B 21/072* (2006.01)

(52) U.S. Cl.
CPC ..... *A63B 21/4049* (2015.10); *A63B 21/0724* (2013.01); *A63B 21/4035* (2015.10)

(58) Field of Classification Search
CPC ..... A63B 21/02; A63B 21/04–0407; A63B 21/0421; A63B 21/0435; A63B 21/055–0557; A63B 21/072–075; A63B 23/14; A63B 2023/003
See application file for complete search history.

(56) References Cited

U.S. PATENT DOCUMENTS 4,461,473 A * 7/1984 Cole ..... A63B 21/0724 482/106
4,690,400 A * 9/1987 Metz ..... A63B 21/0724 482/106
5,080,349 A * 1/1992 Vittone ..... A63B 23/14 482/106
5,211,616 A * 5/1993 Riley, Jr. ..... A63B 21/072 482/106
5,407,405 A 4/1995 Oren
(Continued)

FOREIGN PATENT DOCUMENTS

EP 1 718 372 B1 3/2011
WO 2016191867 A1 12/2016

*Primary Examiner* — Jennifer Robertson
(74) *Attorney, Agent, or Firm* — Maginot, Moore & Beck, LLP

(57) ABSTRACT

An exercise bar assembly includes a pair of rotating grip assemblies, each including a generally planar frame and a hand grip mounted within the frame for rotation within in the plane of the frame. The rotating grip assemblies are attachable to opposite ends of a center bar assembly along the longitudinal axis of the bar assembly. A plate bar assembly is attachable to each of the rotating grip assemblies opposite the center rod, with the plate bar assembly aligned with the longitudinal axis to form a weight lifting bar. A user-selectable elastic band is engageable between the pair of rotating grip assemblies along the longitudinal axis so that the elastic band resists rotation of each hand grip in each of the rotating grip assemblies. The rotating grip assemblies of the exercise bar assembly allow for the full range of motion of the bicep, and the elastic band creates a resistance exercise through the bicep's full range of motion.

16 Claims, 17 Drawing Sheets

(56) References Cited

U.S. PATENT DOCUMENTS

| | | | | |
|---|---|---|---|---|
| 7,094,186 | B2 * | 8/2006 | Diakonov | A63B 21/0728 482/106 |
| 7,238,147 | B2 | 7/2007 | Mills et al. | |
| 7,537,547 | B1 | 5/2009 | Hosick et al. | |
| 7,785,240 | B2 | 8/2010 | Stugart | |
| 7,862,486 | B1 | 1/2011 | Watson | |
| 8,702,574 | B2 | 4/2014 | Abranchess | |
| 8,845,500 | B2 | 9/2014 | Huang | |
| 9,375,601 | B2 | 6/2016 | Miller et al. | |
| 10,029,140 | B2 | 7/2018 | Douglass et al. | |
| 10,058,725 | B2 | 8/2018 | Lacaze | |
| 10,695,604 | B2 | 6/2020 | Porterfield | |
| 10,888,731 | B2 | 1/2021 | Olmstead et al. | |
| 2005/0202942 | A1 | 9/2005 | De Lano | |
| 2008/0176723 | A1 * | 7/2008 | Johnson | A63B 21/0724 482/106 |
| 2012/0094812 | A1 * | 4/2012 | Smiley | A63B 21/05 482/128 |
| 2019/0275365 | A1 | 9/2019 | Bongelli | |

* cited by examiner

EXERCISE BAR WITH DYNAMICALLY ROTATING HAND GRIPS

PRIORITY CLAIM

This application is a continuation-in-part of and claims priority to pending application Ser. No. 17/188,654, filed on Mar. 1, 2021, entitled "EXERCISE BAR WITH DHYANICALLY ROTATING HAND GRIPS", the entire disclosure of which is incorporated herein by reference.

BACKGROUND

The present disclosure pertains generally to an apparatus for use in the field of physical fitness. More particularly, the apparatus is an exercise bar with rotating had grips for use in weight training.

Strengthening the human upper body has long been a popular activity. Long ago, the activity was practiced using a dumbbell which consisted of a short bar equipped with a weight on each end, and formed with a grip portion in the middle of the bar. The weightlifter could grasp the grip portion and focus training on specific muscle groups. For instance, by standing with the dumbbell at the waist, and bending the elbow to "curl" or raise the wrist and forearm upwards, the biceps are strengthened. Also, by standing with the dumbbell behind the weightlifter's shoulder with the elbow bent, pushing the dumbbell upwards strengthens the triceps. By lying on his/her back and holding the dumbbell directly above the chest, pushing up towards the sky in what is called a "press" strengthens the triceps, pectoral, and other major muscle groups. Other strengthening exercises are well known in the art which may utilize one dumbbell or a pair of dumbbells—one in each hand.

In addition to the dumbbells which have been used for many years, so too has the barbell. A barbell consists of an elongated bar formed with a pair of grip portions in roughly the middle of the bar for grasping with the weightlifter's two hands, and equipped with a weight receiver on each end of the bar. By placing weights of different sizes on the weight receivers, a barbell of different weights could be constructed. Similar exercises to those completed with the dumbbells discussed above can also be performed with a barbell. For instance, by standing up with the barbell at the weightlifter's waist and bending the elbows to raise the barbells upwards, a "curl" is performed strengthening the forearms and biceps. Similarly, with the weightlifter lying down and pushing the barbell upwards from the chest, a "press" is performed thereby strengthening the triceps and pectorals.

Because the weights placed on a barbell can be very heavy, it is important to have a proper grip on the grip portion of the barbell. During exercise routines, it is also important that the weightlifter's grip be consistent with the exercise being performed. For instance, the grip in a curl exercise may be very different from an exercise in a press exercise.

However, the grip portion of the conventional barbell is fixed as part of a rigid steel bar, and often perfectly linear. As a result, even though the grip portion may be in a proper position for a weightlifter at the start of the exercise, it is likely that the fixed grip portion of the barbell will be in a non-optimal position during at least a portion of the exercise. For instance, when performing a curl exercise with a barbell having a linear bar and fixed grip portion, the weight lifter's hands are in an acceptable position at the start of the exercise. However, as the barbell is raised upwards, the wrist has a tendency to rotate as the elbow bends upwards. Because the grip portion of the barbell is fixed, there is a significant amount of strain placed on the weightlifter's wrist and forearm. This strain can result in injury caused by excessive torsion on the wrist and forearm, including pulled muscles, strained ligaments, and other injuries requiring orthopedic treatment.

Several attempts to overcome the shortcomings of a straight-bar barbell follow the approach of the supinating barbell disclosed in U.S. Pat. No. 4,690,400, which issued on Sep. 1, 1987 to Metz. The Metz barbell incorporates a pair of circular housings mounted to the bar which supports hand grips mounted for rotation within the housings. In many such devices, the hand grips can freely rotate to accommodate the change in wrist position as the barbell is raised and lowered. Other devices, such as the Metz barbell incorporate a friction mechanism between the grip and the housing to adjust the resistance to rotation of the hand grips from no resistance to a locked engagement. The same friction resistance concept has been incorporated into wrist and forearm exercise devices, such as the rotational exerciser shown in U.S. Pat. No. 8,845,500, which issued on Sep. 30, 2014.

SUMMARY OF THE DISCLOSURE

An exercise bar assembly is provided that comprises a pair of rotating grip assemblies, each grip assembly including a generally planar frame and a hand grip mounted within the frame for rotation within in the plane of the frame. A center bar assembly defining a longitudinal axis and opposite ends along the longitudinal axis, is fixed at its opposite ends to the frame of the rotating grip assemblies along the longitudinal axis. A pair of plate bar assemblies are also fixed to the frame of the rotating grip assemblies along the longitudinal axis.

In one feature of the disclosure, an elastic element is engageable between the pair of rotating grip assemblies along the longitudinal axis. The elastic element can comprise an elongated elastic band having a spring constant for resisting rotation of the hand grip in each of the rotating grip assemblies. An elongated shield is mounted to the center bar assembly to cover the elastic band when it is engaged between the pair of rotating grip assemblies.

Each of the pair of rotating grip assemblies include an ring plate defining a circumference and rotatably mounted in the frame for rotation within the plane of the frame. The ring plate carries the hand grip and can be rotated at least between a position in which the hand grip is perpendicular to the longitudinal axis and a position in which the hand grip is aligned with the longitudinal axis.

In a further feature of the disclosure, a plurality of bearing posts project perpendicularly from the ring plate, with one bearing post arranged on the ring plate to be aligned with the longitudinal axis when the hand grip is perpendicular to the longitudinal axis. The other bearing posts are spaced 45 degrees apart from the one bearing post around the circumference of the ring plate. The elongated band includes a collar at each end thereof that is configured to be mounted on any of the bearing posts of each of the pair of rotating grip assemblies. When the elongated band is mounted on the one bearing post, for instance, manual rotation of the hand grips, and thereby rotation of the rotating grips assemblies, causes the elastic band to contact successive ones of the bearing posts in the direction of rotation of the hand grip.

In one feature, each of said plurality of bearing posts includes a spool rotatably mounted to the ring plate, with the spool defining a circumferential groove. The elastic band includes a collar at each end that is configured to be pressed or pushed down onto the spool to engage the collar to the spool.

In another feature, each of said rotating grip assemblies includes a pair of identically configured bearing rings that are rotatably seated in an opening of the frame. The bearing rings each include a plurality of bearing bars projecting from the bearing ring and spaced apart around the circumference of said lower bearing ring. The bearing bars on the two bearing rings are configured to interdigitate or nest about the ring plate to provide a circumferential bearing surface for relative rotating of the ring plate.

DETAILED DESCRIPTION

Figure 1:
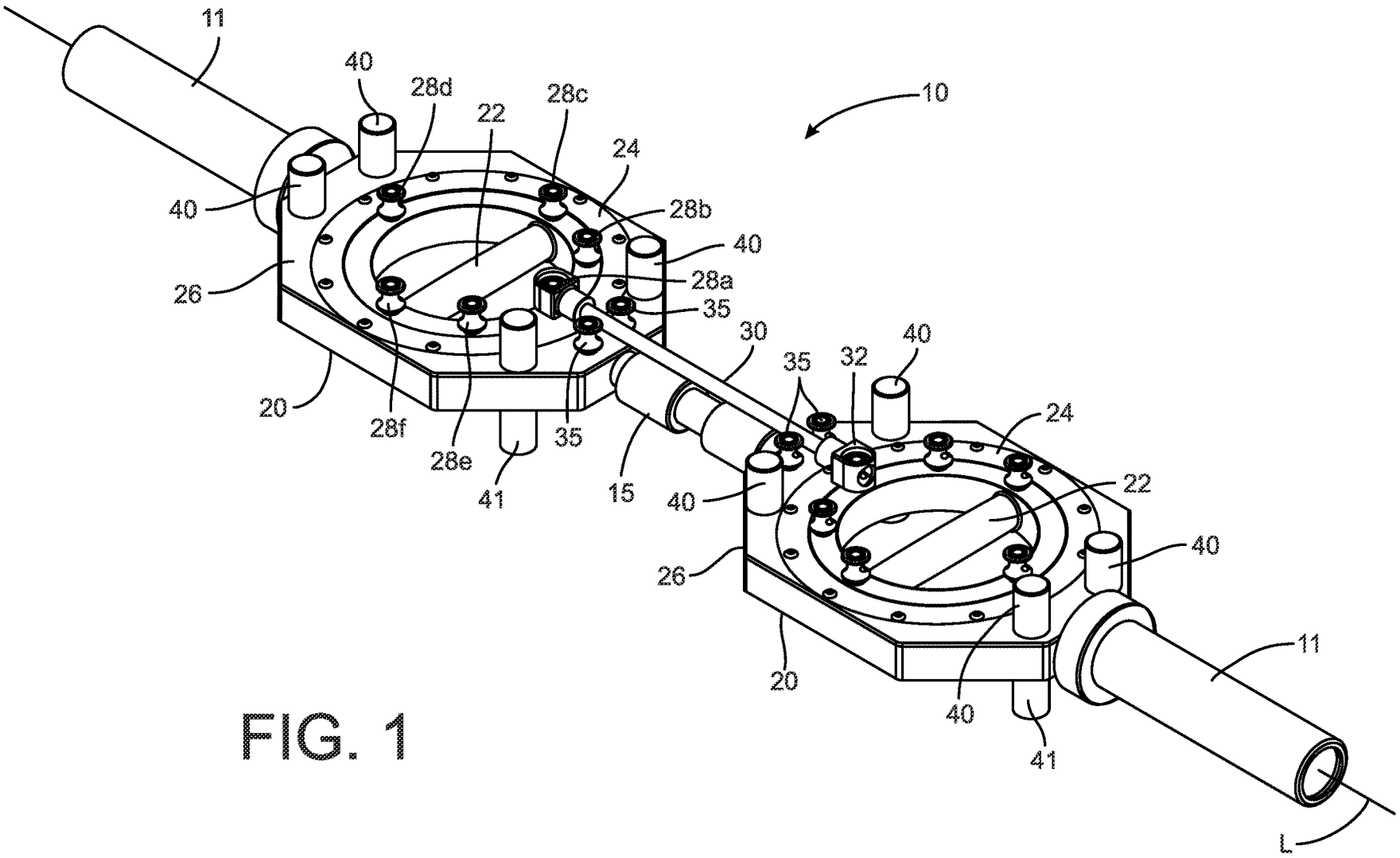
FIG. 1 is a top perspective view of an exercise bar assembly according to one aspect of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

An exercise bar assembly 10 shown in FIG. 1 includes a pair of plate bar assemblies 11 that can be weighted and/or configure to receive conventional weight plates. The length of the plate bar assemblies 11 depends on the intended use of the bar assembly, and in particular the amount of weight expected to be carried by the bar assembly. A length of 8-14 inches is typical. Each plate bar assembly is fastened to a rotating mount assembly 24, and in particular to a rigid generally planar frame 26 of the mount. The frames of the two rotating mount assemblies 26 are connected to each other by a center bar assembly 15. The combination of the plate bar assemblies 11, center bar assembly 15 and the frames 26 form the barbell. Thus, the assembly of these components must be strong enough to support the weight carried by the plate bar assemblies 11 during use of the exercise bar assembly 10. The center bar assembly 15 has a length that is sized to locate the rotating mount assemblies at an ideal location for the person to comfortably lift the bar assembly during a workout. Nominally, the person will grasp a conventional barbell with the hands roughly shoulder-width apart. Some weight-lifting exercises require the grip positions to be moved inboard or outboard. As described herein, the present disclosure contemplates that the center bar assembly can be provided in different lengths to provide different grip positions.

The rotating mount assemblies 24 support hand grips 22 for rotation in the plane of the frames 26. The hand grips 22 are conventionally sized to be comfortably grasped by the user. As described in more detail herein, a bearing assembly supports each of hand grips within its corresponding frame and permits smooth rotation of the grips relative to the frame. Each rotating mount assembly 24 includes a plurality of bearing posts **28*a*-28*f* projecting from one side of the mount, as shown in FIG. 1. In one feature of the bar assembly 10, an elastic band 30 includes a mounting collar 32 on each end that is adapted to be mounted on a bearing post on the two rotating mount assemblies 24. The elastic band spans between the two rotating grip assemblies 20 over the center bar assembly 15. The band passes through a gap formed between two fixed bearing posts 35 that are fixed to the frame 26 of each hand grip assembly 20**.

As can be readily appreciated, the elastic band 30 provides elastic resistance to rotation of the hand grips 22 relative to the corresponding frames 26. The elastic band 30 can be in several forms, such as a resistance work-out band or a bungee cord, with a predetermined resistance against elongation or a predetermined spring constant. The band must be capable of repeated extension and elastic retraction without failure and preferably incorporates an outer surface capable of low-friction engagement with the bearing posts, as described herein. In one embodiment, shown in FIG. 9, the bearing posts include a spool **29*a* rotatably mounted on a post 29*b*, that is in turn mounted to the frame by a threaded post 29*c*. The spool 29*a* defines a circumferential groove 29*d*** to receive the elastic band, as described below. Since the elastic band is intended to provide resistance against rotation of the hand grips, the rated force of the band is less than for a conventional work-out resistance band. In one specific embodiment, the elastic band can have a spring constant to achieve rated force of ten pounds at a maximum elongation of about 250%.

Figure 2:
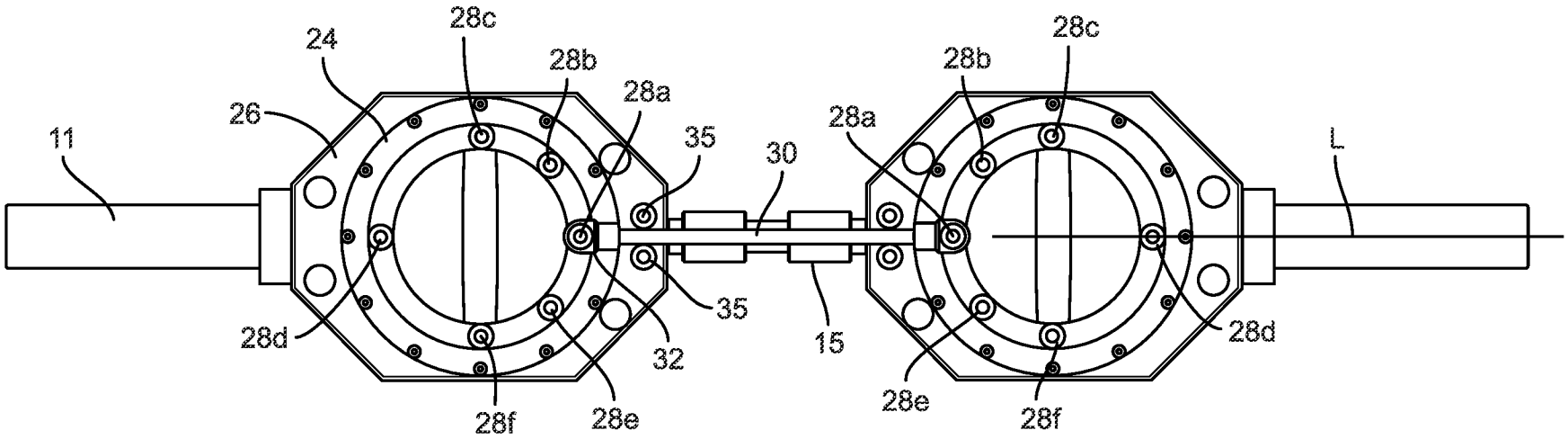
FIG. 2 is a top view of the exercise bar assembly shown in FIG. 1.
Figure 3:
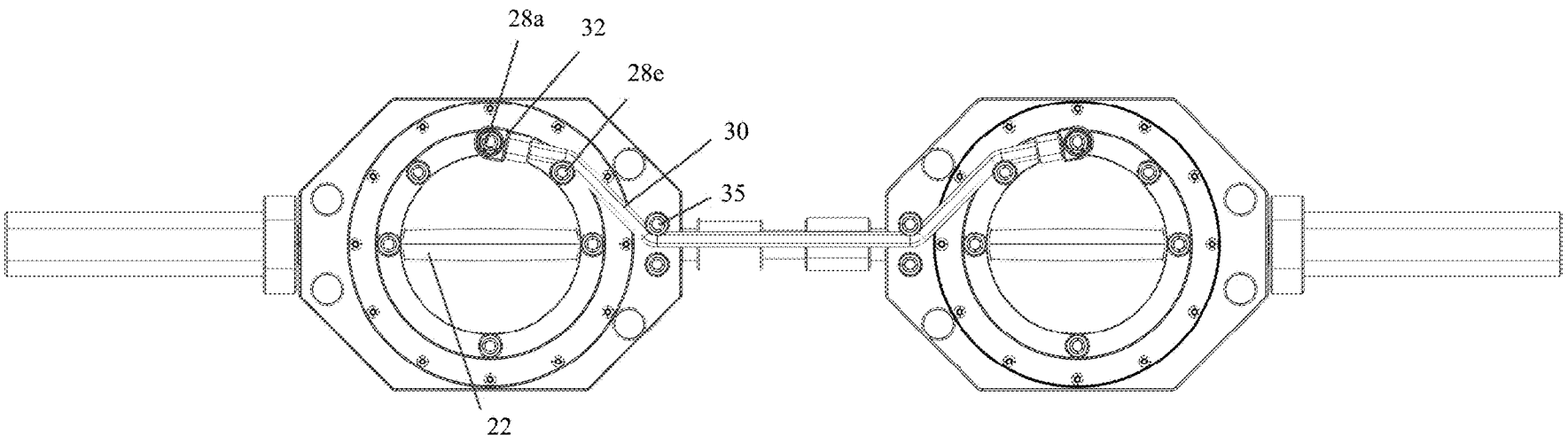
FIG. 3 is a top view of the exercise bar assembly shown in FIG. 1, shown with the rotating grip assemblies rotated from a first starting position.
Figure 9:
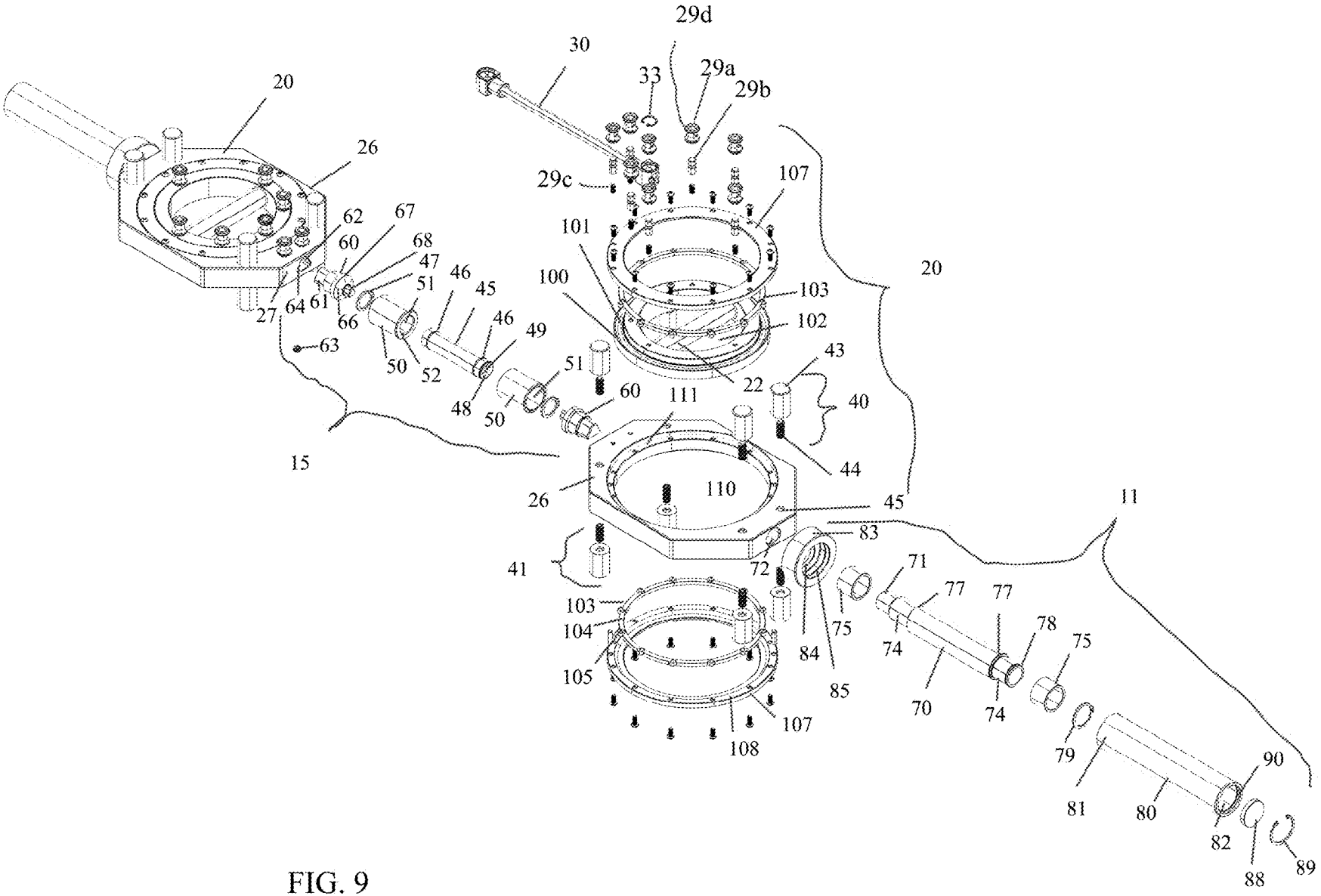
FIG. 9 is an exploded perspective view of the exercise bar assembly shown in FIG. 1.

In a baseline position, the hand grips are oriented perpendicular to the longitudinal axis L along the length of the bar assembly, as depicted in FIG. 1. The mounting collar 32 of the elastic band 30 is mounted on a baseline or first bearing post 28*a*, as shown in FIG. 2, and held in place by a snap ring 33 (FIG. 9). In this baseline position, the elastic band is at its neutral, unstretched length. When the two hand grips are rotated 90° from this baseline position, or first starting position, as shown in FIG. 3, the elastic band is stretched because the mounting collars 32 at the end of the band are carried with the first bearing post 28*a* as the respective rotating mount assemblies 24 are rotated. As the hand grips are rotated, the elastic band first engages one of the fixed bearing posts 35 and then engages the next successive bearing post 28*e* for a counter-clockwise rotation of the left-hand grip and a clockwise rotation of the right-hand grip. It can be appreciated that when executing a curl, the wrists have a tendency to rotate outward as the bar assembly is lifted. The length of the elastic band increases as the position of the bearing posts on which mounting collars are engaged move circumferentially with the rotation of each rotating mount assembly 24. The change in length is roughly equal to ¼ the circumference of the rotating mount assembly for a 90° rotation of one the hand grips, or double that value for rotation of both hand grips. Thus, in the illustrated embodiment of FIG. 3, the elastic band is elongated about 150%.

Figure 4:
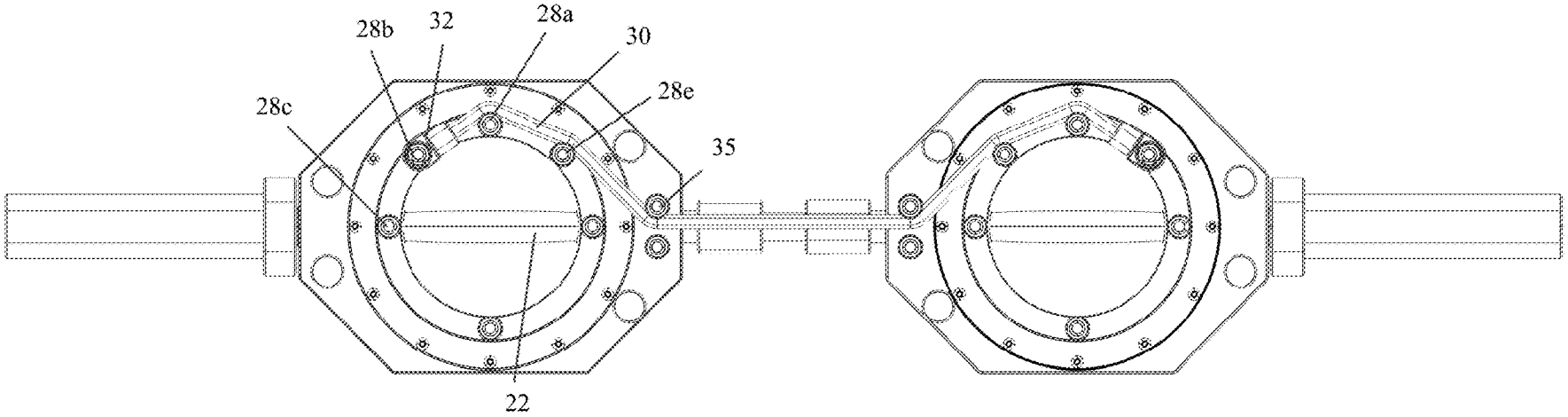
FIG. 4 is a top view of the exercise bar assembly shown in FIG. 1, shown with the rotating grip assemblies rotated from a second starting position.
Figure 5:
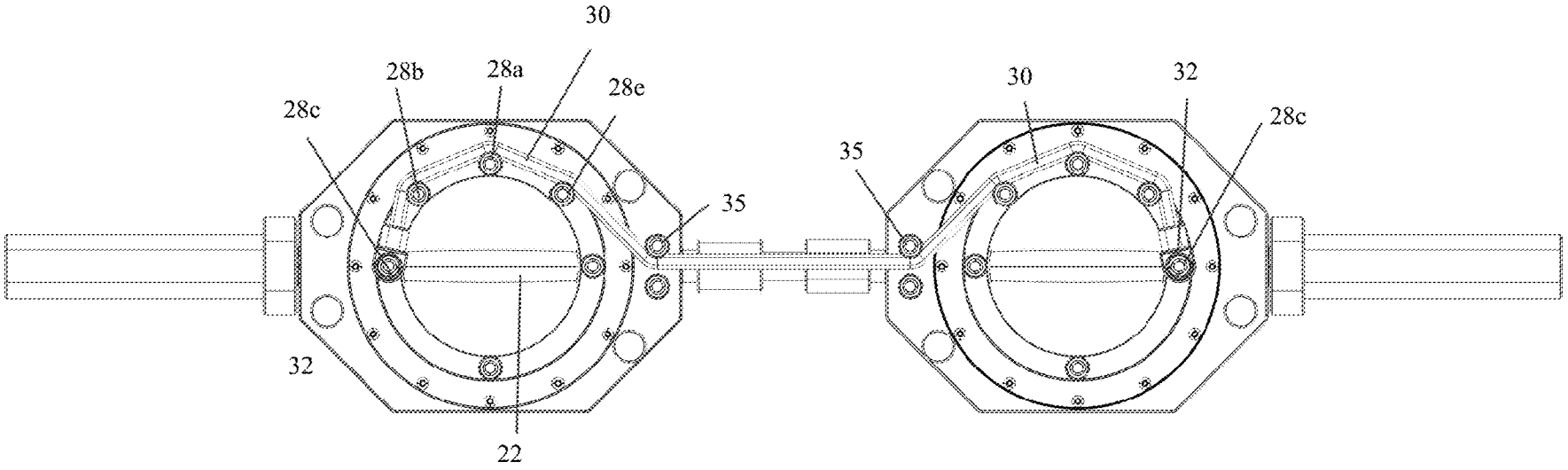
FIG. 5 is a top view of the exercise bar assembly shown in FIG. 1, shown with the rotating grip assemblies rotated from a third starting position.
Figure 6:
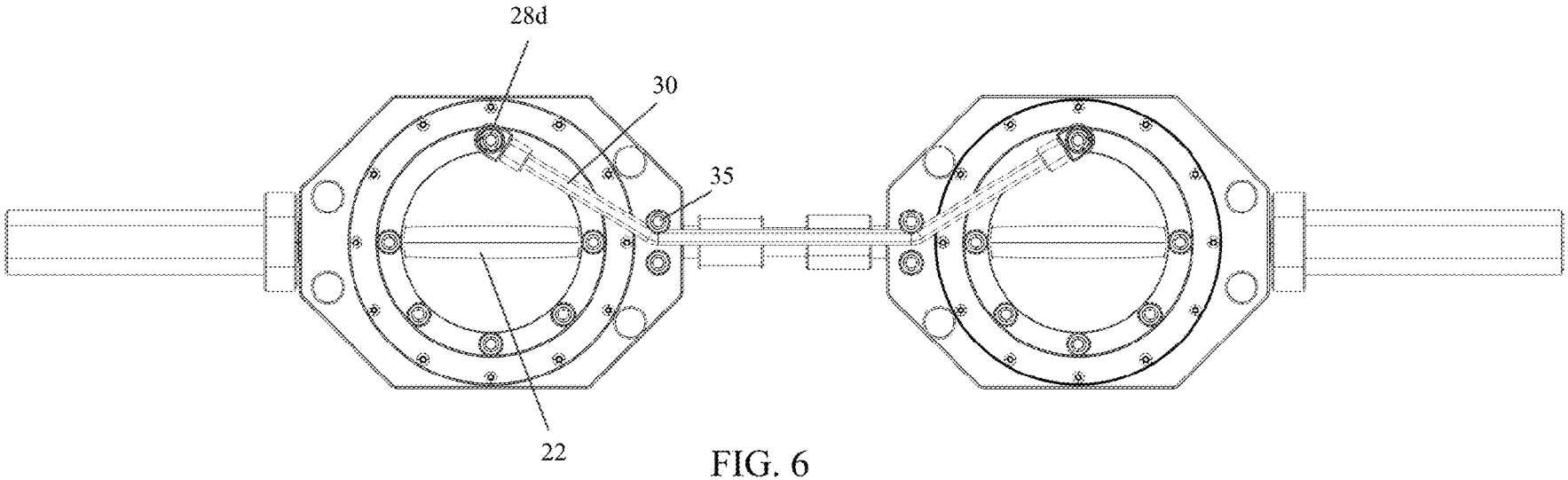
FIG. 6 is a top view of the exercise bar assembly shown in FIG. 1, shown with the rotating grip assemblies rotated from a fourth starting position.
Figure 7:
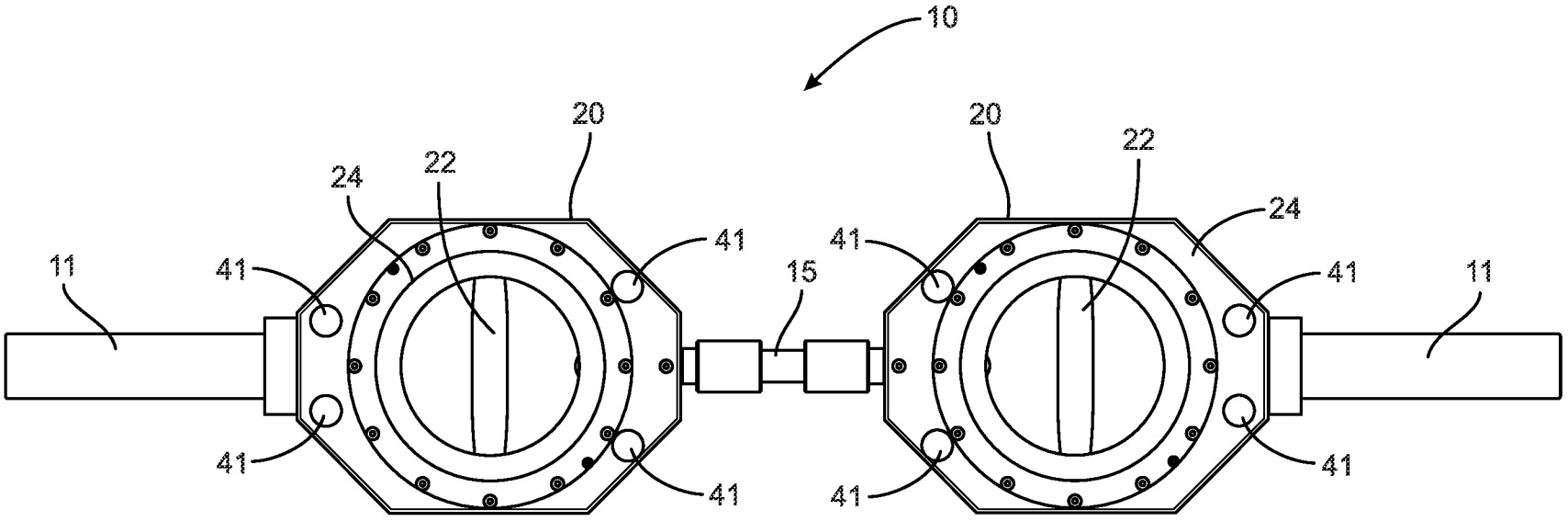
FIG. 7 is a bottom view of the exercise bar assembly shown in FIG. 1.

As shown in FIG. 2, each rotating mount assembly 24 includes a plurality of bearing posts distributed around the circumference of the mount. In the illustrated embodiment, seven bearing posts are provided, with posts 28*a* and 28*d* oriented along the longitudinal axis L of the bar assembly, and 180° opposite each other. Two bearing posts 28*b*, 28*c* are spaced at 45° intervals in the counter-clockwise direction on the left-side rotating mount assembly from the baseline post 28*a* (or clockwise on the right-side mount). Two bearing posts 28*e* and 28*f* are spaced at 45° intervals in the clockwise direction on the left-side rotating mount assembly from the baseline post 28 (or counter-clockwise on the right-side mount). These additional mounts engage the elastic band 30 as the rotating mount assemblies are rotated so that the band is stretched across the posts, as shown in FIG. 3. In addition to this feature, the additional mounts provide a different mounting point, or starting point, for the collar 32 of the elastic band 30, which allows the user to vary the resistance force at the 90° rotation of the and grips 22. Thus, as shown in FIG. 4, the mounting collar 32 of the elastic band 30 can be mounted on the bearing mount 28*b*, instead of the baseline bearing mount 28*a*. With the elastic band anchored at this second starting location, the 90° rotation of the hand grip stretches the band 30 essentially 45° farther around the circumference of the rotating mount assembly than when starting at the baseline position 28*a*. With the starting position of the elastic band on the bearing mounts 28*b*, the 90° rotation of the hand grip elongated the elastic band by about 200%. The full elongation of the elastic band (about 250%) can be achieved if the collars 32 of the elastic band are mounted on the bearing mounts 28*c* at the third starting location shown in FIG. 5. On the other hand, the minimal elongation is achieved by placing the band mounting collars on the bearing posts 28*d*, as shown in FIG. 6. In this fourth starting position, the 90° rotation of the hand grip 22 does not draw the elastic band 30 across any other bearing mount, as in the previous positions. The elongation of the band is less than the elongation shown in FIG. 3 because the band is not drawn across the bearing post 28*f*. The band is elongated about 140% when mounted to posts 28*d*.

It should be understood that the exercise bar assembly 10 of the present disclosure can be used to perform the full range of arm exercises and lifts. The rotating mount assembly 24 for the hand grips 22 allows the grips to rotate as the arm is lifted or lowered, in accordance with the natural physiology of the wrists and forearms. The incorporation of the elastic band 30 between the rotating mount assemblies adds resistance to the natural forearm rotation, which in turn adds another level to the arm exercise. The user can adjust the amount of resistance to rotation by mounting the elastic band on different bearing posts, thereby varying the elongation from 140% to 250%. The user can also adjust the amount of resistance by selecting from a plurality of elastic bands having different spring constants or rated forces. The elastic band 30 can be easily removed and replaced with a different elastic band.

The bar assembly 10 also allows the user to rotate the hand grips inward—i.e., clockwise with the left hand and counter-clockwise with the right hand—to provide a negative bicep workout. For this type of workout, the elastic band 30 is mounted on the posts 28*f* so that the grips 22 are parallel to the bar axis L. Rotation of the hand grips draws the elastic band down across the lower fixed post 35 and across the bearing post 28*e* until the hand grip is in the perpendicular position. The elastic band is elongated as the left rotating mount assembly 24 rotates clockwise and the right mount rotates counter-clockwise.

Figure 8:
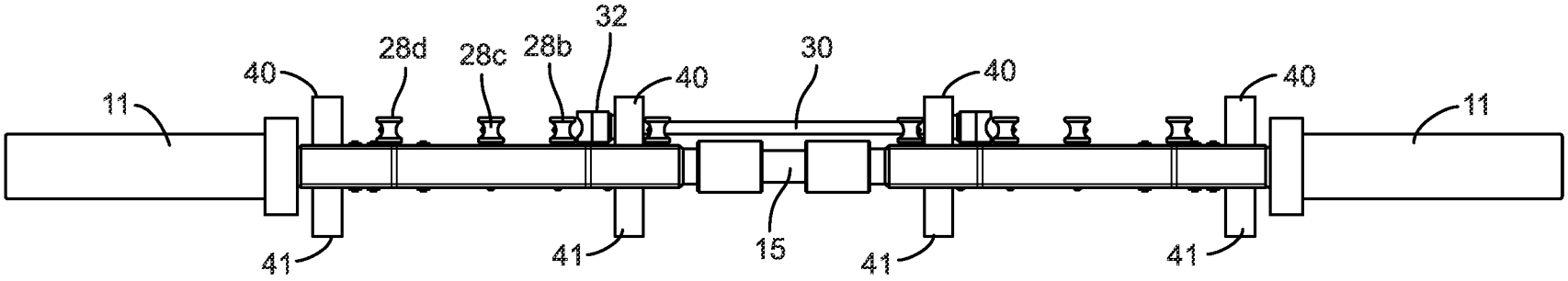
FIG. 8 is a side view of the exercise bar assembly shown in FIG. 1.

Further features of the exercise bar assembly 10 are shown in FIG. 1 and FIGS. 7-9. The rotating grip assemblies 20 include a plurality of support posts 40 projecting from the top side of the frame 26 of each assembly, and a like plurality of posts 41 projecting from the bottom side of the frames, as best seen in FIG. 8. The support posts are sufficiently tall for the bar assembly to be supported on a surface, such as the floor, with clearance for the plate bar assemblies 11 and the bearing posts 22. The support posts 40, 41 allow a user to perform push-ups with the exercise bar assembly 10 sitting on the floor. In this respect, the bar assembly 10 works like a push-up disc known in the art. However, the elastic band 30 between rotating mount assemblies adds a feature not found in the conventional push-up discs. In one embodiment, the support posts can include a stud 43 into which is threaded a mounting screw 44. The mounting screw is in turn threaded into a bore 45 defined in the frame 26 of the rotating mount assembly 24. This allows the support posts 40, 41 to be removed as desired. The stud can have a hex configuration for engagement with a wrench or can include some other feature to be engaged by a driving tool.

In one embodiment, the exercise bar assembly 10 allows the rotating grip assemblies 20 to be separated by different distances to provide different grip locations. As mentioned above, for a conventional bicep curl, the exercise bar is optimally gripped at shoulder width. Of course, shoulder width varies among users, so while a grip spacing of 24 inches may be comfortable for many users, shorter or taller users may require different grip spacing. In addition, different exercises require different grip locations, inside and outside shoulder-width, to work different muscle groups. Thus, in one aspect of the present disclosure, the exercise bar assembly 10 can be provided with an adjustable or modifiable center bar assembly 15 spanning the space between the two rotating handle assemblies 20. In particular, the center bar assembly 15 includes a center bar 45 that can be provided in different lengths. In particular, the user can select from several center bars 45 of different lengths to find a suitable grip width.

Each center bar 45 is configured to be removed from the center bar assembly 15 for ready replacement. Thus, in one embodiment, the center bar 45 includes snap ring grooves 46 adjacent the opposite ends of the bar, as shown in FIG. 9. The grooves are configured to receive a snap ring 47. The assembly further includes a pair of collars 50 arranged at the opposite ends of the center bar 45, each defining a bore 51 through which the center bar extends. The end of the collars facing the center bar define a circumferential flange 52 that is sized to trap the snap rings 47 within the collars, thereby locking the collars 50 to the center bar 45. It can be appreciated that the collars and center bar can be assembled by first introducing one end of the center bar 45 into the bore 51 of one collar with the snap ring groove 46 accessible at the opposite end of the collar for engagement of the snap ring 47. Once the snap ring is engaged, the first collar can be slid to the end of the rod so that the second collar can be slid onto the second end of the rod. The second end is accessible outside the bore 51 of the second collar for engagement of the snap ring 47 with the groove at the second end of the rod, thereby fixing the second collar to the rod.

In can be appreciated that this intermediate assembly of the center rod 45 and the two collars 50 is a loose assembly since the collars are free to slide along the rod, although they are prevented from becoming disengaged by the snap rings 47. The center bar assembly 15 thus includes a mounting element 60 that is configured to fix the intermediate assembly to the frames of the respective rotating grip assemblies 20, while simultaneously pushing the snap rings 47 against the end flanges 52 of the two collars 50. The mounting element 60 includes an outboard stud 61 that is configured for a close-fit with a bore 62 defined in an end face 27 of the frame 26. In one embodiment, the outboard stud 61 and bore 62 define complementary shapes, such as the triangular shape shown in FIG. 9. The stud 61 is pressed into the bore 62 and held in place by a set screw 63 threaded through a threaded bore 64 that intersects the bore 62. The element 60 further includes a conical end face 66 that is configured to engage a complementary conical surface 48 in each end of the center rod 45. An inboard stud 68 projects from the conical end face 66 and is configured to be seated in a complementary shaped bore 49 in each end of the rod 45. The inboard stud 68 and complementary bore 49 can have a non-circular shape, such as the triangular shape shown in FIG. 9. It can thus be appreciated that the center bar 45 is fixed against rotation along its axis by way of the non-circular interfaces between the studs 61, 68 and their respective complementary bores 62, 49.

The assembly is clamped together by a threaded portion 67 of the component 60 that threads into a threaded end (not shown) of the bore 51 of the collar 50. The collar is not constrained against rotation, so it can be rotated to thread itself onto the threaded portion 67 of the rotationally fixed component 60. The exterior of the collar 60 can be configured to receive a tool, such as a wrench, or can include knurling or some other grip enhancing feature that permits manual tightening. The threads can be self-locking threads so that the components of the center bar assembly 15 remains rigidly coupled during use of the bar assembly 10. As the collar is threaded onto the threaded portion 67 of the mounting element 60 the inboard stud 68 engages the complementary opening 49 in the center bar 45 and the conical end face 68 engages the conical surface 48 of the bore. Continued rotation of the collars 50 gradually clamps the center bar 45 between the mounting elements 60, forming a rigid connection between the center bar and the two rotating grip assemblies 20.

It can be appreciated that this assembly 15 allows a user to easily replace the center bar 45 with a bar of different length in order to adjust the grip width for the exercise bar assembly 10. In one embodiment, the assembly 15 is provided to the user as a completed assembly with the mounting elements 60 at the ends of the center bar assembly free to be placed with the respective openings 62 in the left and right frames 26. Additional assemblies with longer center bars 45 can be provided to the user in a completed assembly. Alternatively, the user can be permitted to disassemble the center bar assembly 15, by first unthreading the two collars 50 from the threaded portion 67 of the mounting elements 60 so that the center bar and collars can be removed. One collar is slid down the center bar toward the opposite end to expose one of the snap rings 47 for removal. The associated collar is removed and the other collar slid down the center bar to expose the other snap ring for removal. The process can be reversed to add a new center bar 45 to the assembly 15.

The plate bar assemblies are also configured to be removed from the exercise bar assembly 10. It can be appreciated that the plate bar assemblies 11 and the center bar assembly 15 can be removed from the rotating grip assemblies 20 to break down the entire exercise bar assembly 10 for storage or transport. In addition, removing the plate bar assemblies can essentially convert the remainder of the exercise bar assembly 10 to a wrist/forearm exercise apparatus rather than a weight lifting apparatus.

The plate bar assembly 11 includes an inner bar 70 with a threaded end 71 for engagement with a threaded bore 72 in the frame 26 of each rotating grip assembly 20. The inner bar includes bearing seats 74 at the opposite ends of the bar to receive bearings 75. The bearings abut a shoulder 77 of the inner bar, with one bearing held in place between the shoulder and an end face 84 of an anchor cap 83, and the other bearing held in place against the shoulder by a snap ring 79 fixed in a snap ring groove 78 at the outboard end of the bar 70. It can be understood that the anchor cap 83 is trapped between the inner bar 70 and the face of the frame 26 when the threaded end 71 of the inner bar 70 is threaded into the bore 72.

The plate bar assembly 11 further includes an outer bar 80 having a bore 82 sized to fit over the inner bar, and in particular to have a close running fit with the outer surfaces of the bearings 75. The outer bar 80 includes a threaded end 81 that is configured to engage internal threads 85 of the anchor cap 83. The outer bar 80 can be fixed to the inner bar 70 by way of the threaded engagement with the anchor cap 83, with the anchor cap in turn fixed to the frame 26 by the threaded engagement of the inner bar 70 with the frame. A cover plate 88 covers the bore 82 and is held in place by a snap ring placed within groove 90 at the end of the outer bar.

The rotating grip assemblies 20 include a ring plate 100 that includes the handle 22 spanning a center opening 102 of the plate. The center opening 102 is sized so that a user can easily grasp the grip 22 with sufficient clearance to avoid contacting the ring plate 100. In one embodiment, the center opening can have a diameter of 6-8 inches. The ring plate is configured to be received for free rotation within the circular opening 110 in the frame 26. The upper and lower perimeter of the ring plate define a bearing channel 101. The assembly further includes upper and lower bearing assemblies 103 that include a plurality of ball or roller bearings 105 contained within a circular cage 104. The ball bearings are configured for rolling movement within the bearing channels 101 on the top and bottom faces of the ring plate. The ring plate and bearing assemblies 103 are held in place within the opening 110 of the frame by outer race plates 107. The outer race plates each define a bearing channel 108 to receive the ball bearings 105 of the bearing assemblies. The outer race plates 107 are fastened to a mounting flange on each side of the frame 26, such as by bolts or other conventional fasteners. The ring plate 100 and the two bearing assemblies 103 are thus sandwiched between the two outer race plates 107 so that the ring plate, and therefore the hand grip 22, is free to rotate within the frame. It can be appreciated that the bearing posts 28*a*-28*f* are mounted to the upper face of the ring plate 100 of each rotating mount assembly 24

The present disclosure should be considered as illustrative and not restrictive in character. It is understood that only certain embodiments have been presented and that all changes, modifications and further applications that come within the spirit of the disclosure are desired to be protected. For instance, the center bar assembly 15 can be replaced with a single center bar that integrates the mounting element 60 into the ends of the bar. Alternatively, the center bar assembly can be replaced with a single bar that is integral with the two frames 26. Likewise, the plate bar assemblies 11 can each constitute a single bar with the threaded end 71 for engagement with the threaded bore 72 in each frame. Alternatively, the plate bar assemblies can be replaced with a single bar that is integral with the two frames.

It is further contemplated that other bearing arrangements can be implemented to support the rotating mount assembly 24 within the frame 26 of the rotating grip assemblies 20. For instance, the outer rim of the ring plate 100 can be provided with bearing elements for engaging the inner circumference of the frame 26 at the opening 110. Alternatively, the outer rim of the ring plate and the inner circumference of the frame can be configured for sliding surface-to-surface contact, by providing the surfaces with a low friction material, such as TEFLON®. The bearing channel 101 of the outer race plates 107 can also be configured for sliding surface-to-surface contact with the top and bottom faces of the ring plate 100.

Figure 10:
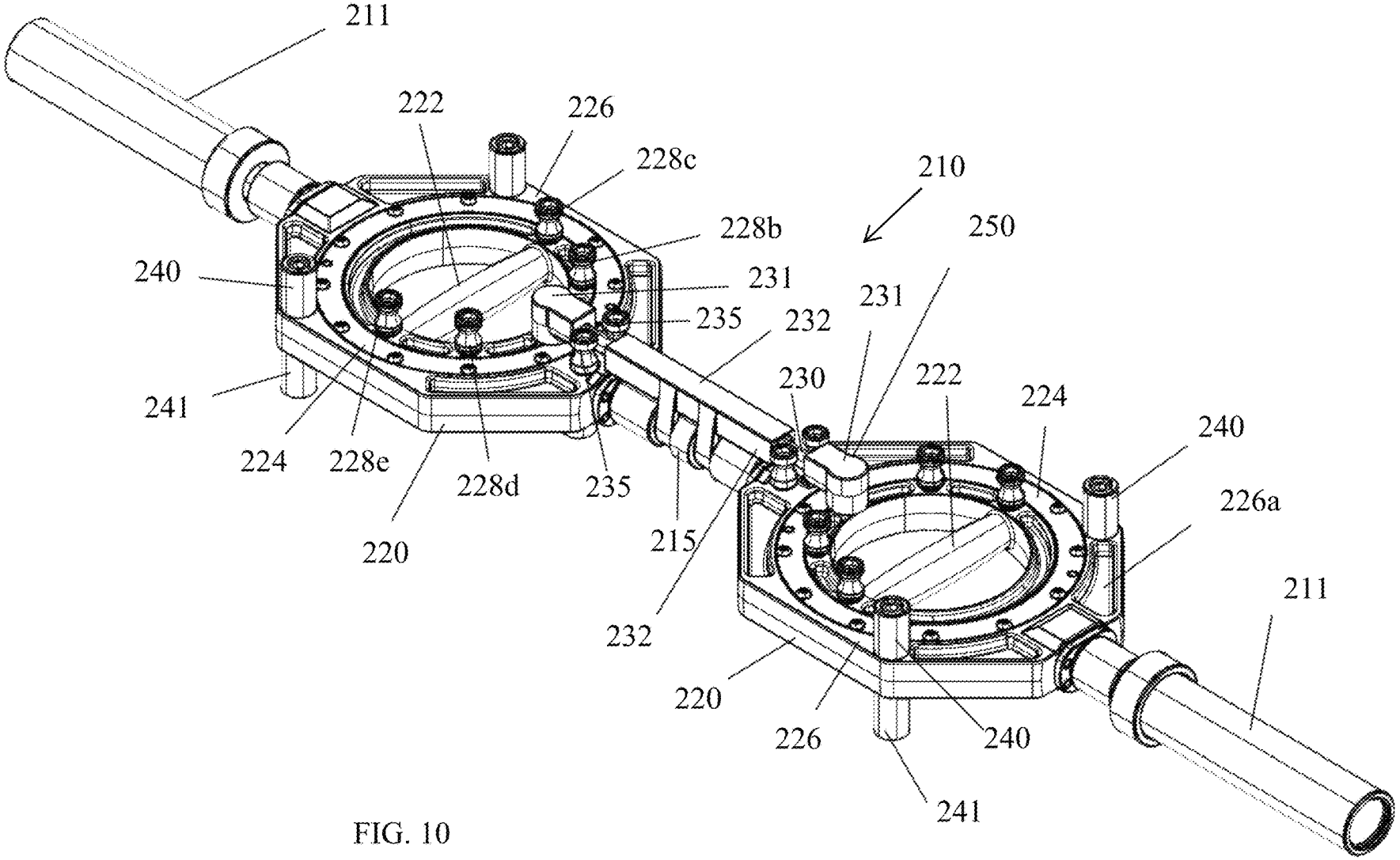
FIG. 10 is a top perspective view of an exercise bar assembly according to another embodiment of the present disclosure.
Figure 11:
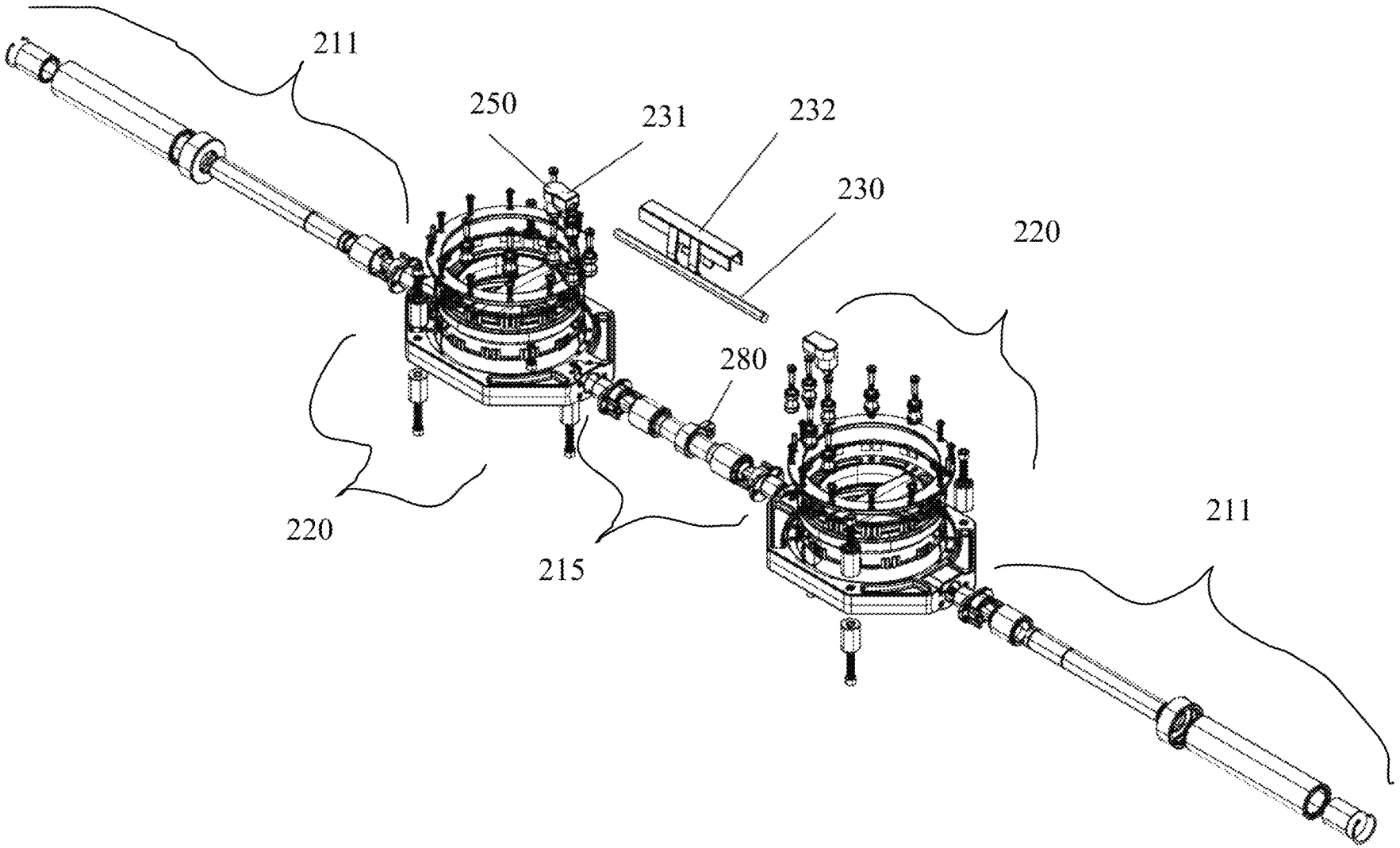
FIG. 11 is an exploded perspective view of the exercise bar assembly shown in FIG. 10
Figure 12:
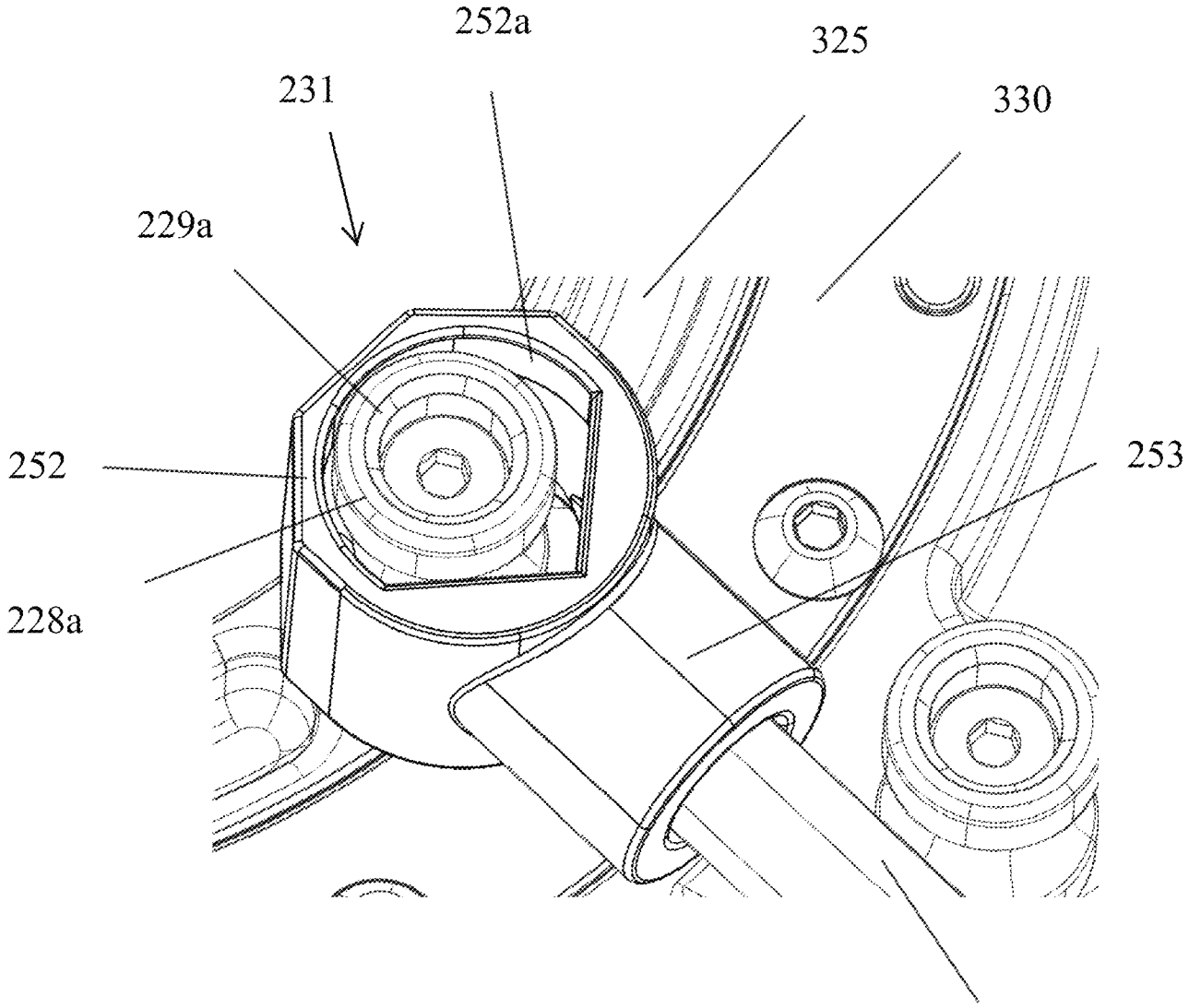
FIG. 12 is an enlarged view of the mounting of the elastic band onto a bearing post of the exercise bar assembly shown in FIG. 10.

A modified exercise bar assembly 210 is shown in FIGS. 10-17. It is understood that the assembly 210 operates in the same manner as the assembly 10, and is capable of the positions shown in FIGS. 2-6. Referring to FIG. 10, the modified bar assembly 210 includes a pair of plate bar assemblies 211, each connected to a corresponding grip assembly 220, with the grip assemblies connected by a center bar assembly 215. The grip assemblies 220 include a hand grip 222 fixed to a rotating mount assembly 224 that is rotatably mounted within a circular opening 227 of a planar frame 226. In this respect, the grip assemblies 220 are similar to the grip assemblies 20. In order to reduce material, the planar frame 226 includes cut-outs 226*a* at the four corners of the planar frame.

As with the prior grip assemblies, the grip assembly 220 includes a plurality of bearing posts 228*a*-*e* on which an elastic band 230 is mounted. The bearing assemblies are distributed across half the circumference of the rotating mount assembly 224 to provide varying degrees of resistance as the hand grips 222 are rotated by the user, as described above. The grip assemblies each include fixed bearing posts 235 positioned at the inboard position on the frame 226 to define a gap for passage of and contact with the elastic band as the rotating mount assembly 224 is rotated within the frame. The grip assembly 220 is also provided with upper and lower support posts 240, 241, respectively, that allow the exercise bar assembly 210 to be used as a push-up bar, as described above.

Figure 15:
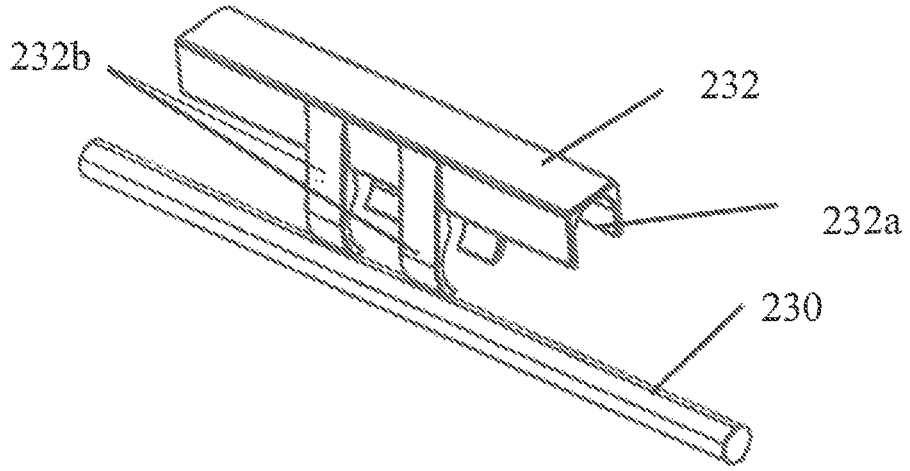
FIG. 15 is an enlarged view of the center bar assembly of the exercise bar assembly shown in FIG. 10.
Figure 15:
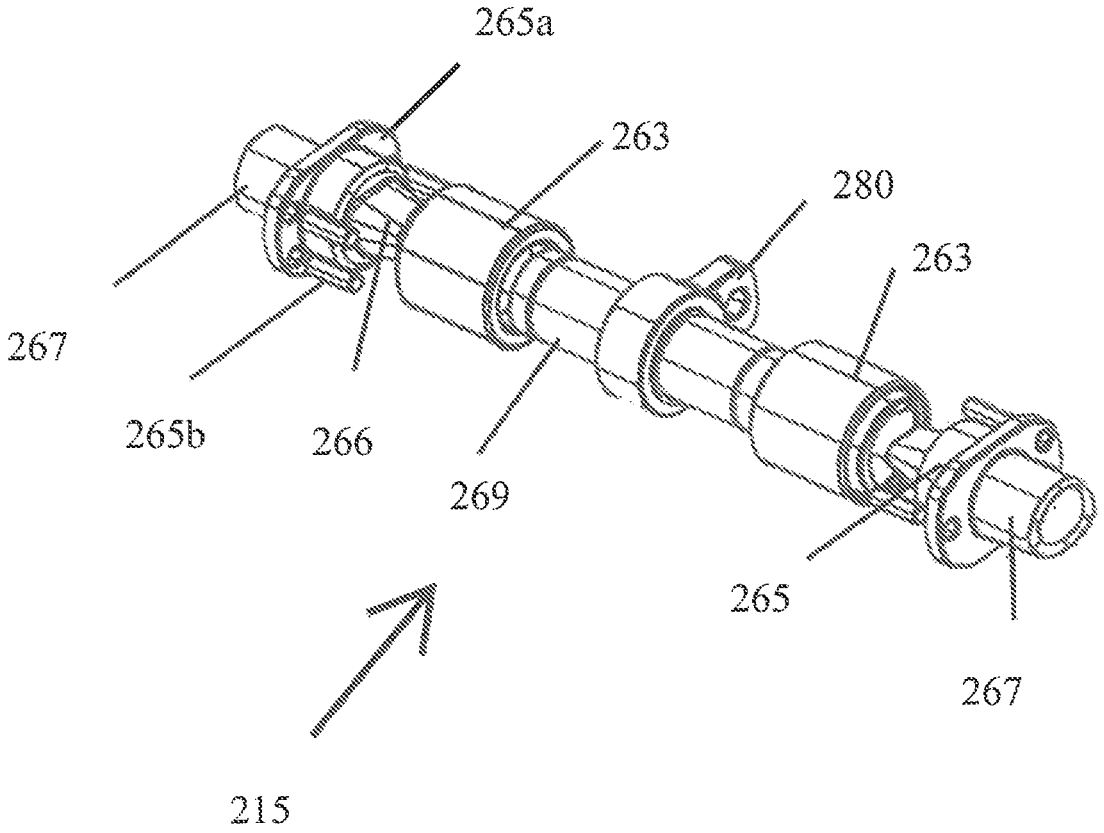

In a modification from the previous embodiment, the exercise bar assembly 210 includes a shield 232 attached to the center bar assembly 215 and covering the elastic band 230. As shown in FIG. 15, the shield 232 defines a channel 232*a* to receive the elastic band 230. The shield includes a set of clips 232*b* that are configure to clip onto the center bar 250 of the center bar assembly 215. As shown in FIG. 10, the shield 232 substantially encloses the band 230, which protects the band from accidental contact with the user, and provides a failsafe feature to contain the band should the band snap during use. The clips allow the shield to replace the elastic band or to disassemble the exercise bar assembly 210.

The elastic band 230 can be the same as the band 30 described above. The band is mounted on a bearing post 228*a*-*e* of each grip assembly 220 by a mounting collar assembly 231, shown in detail in FIGS. 12-13. The first bearing post 228*a* is at the baseline position, with the other bearing posts distributed in the clockwise and counter-clockwise directions around a ring plate 325.

As with the previous embodiment, the bearing posts 228*a*-*e* each include a spool 229*a* mounted to the rotating mount assembly 224 by a post 229*b* threaded into a ring plate 325 of the mount assembly. The spool 229*a* defines a circumferential groove 229*d* that permits quick engagement and release of the mounting collar assembly 231. In particular, the assembly includes a mounting collar 252 that defines a bore 252*a* that is sized to receive the spool 229*a*. The surface of the bore 252*a* defines a bulge 252*b* that is configured to conform to the circumferential groove 229*d* of the spool. The bulge 252*b* can extend less than 180° around the interior of the bore 252*a*. The collar 252 is formed of a deformable material, such as a heavy-duty plastic, so that the bulge 252*b* can be resiliently compressed as the collar 252 is pushed down onto the spool 229*a*. Since the load generated on the collar and spool is transverse to the longitudinal axis of the spool, there is no significant force attempting to dislodge the collar from the spool, once it is snapped into place. On the other hand, the collar can be readily removed the spool by an upward force on the collar to dislodge the bulge 252*b* from the groove 229*d*. Alternatively, the bore 252*a* is configured so that the collar can be mounted on the spool without initially contacting the bulge 252*b* with the groove 229*d*. Once the band 230 is mounted on the bearing posts of both grip assemblies 220, the band is stretched so that the tension in the band holds the bulge 252*b* of each collar 252 within the groove 229*d* of the respective spool 229*a*. The mounting collar assembly 231 includes a cap 250 that snaps onto either or both of the spool 229*a* and mounting collar 252.

Figure 13:
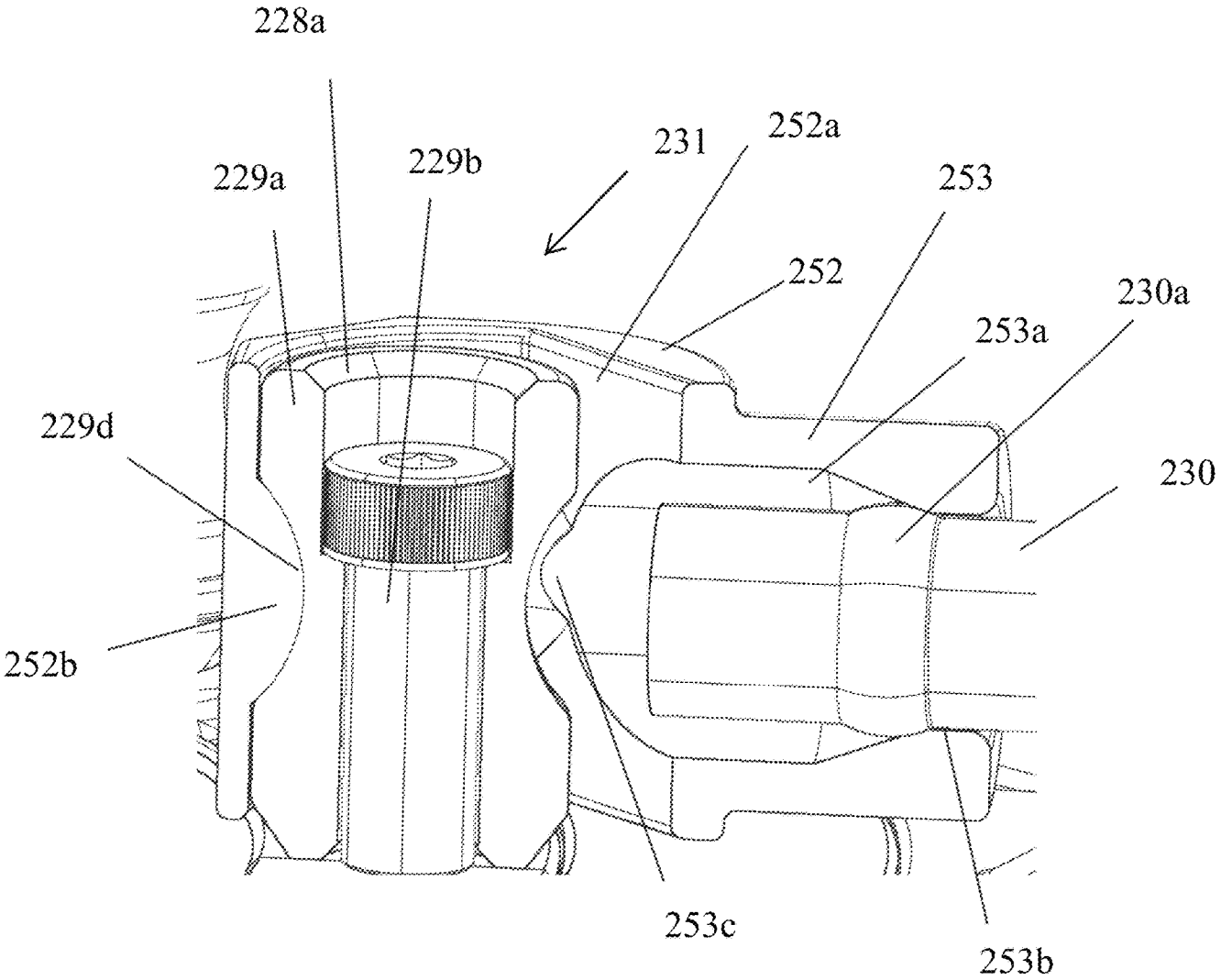
FIG. 13 is a side partial cross-sectional view of the mounting shown in FIG. 12.

Each collar 229*a* includes an integral band support 253 which defines a central bore 253*a*, transverse to said bore 252*a*, through which the band extends, as best shown in FIG. 13. The band 230 includes a circumferential ferrule 230*a* that is sized to fit within the bore 253*a*. However, the bore defines a reduced diameter opening 253*b* that is sized to allow passage of the band 230, but not the ferrule 230*a*. The interaction between the opening 253*b* and the ferrule 230*a* holds the band in engagement with the support 253 and collar 252 when the band is under tension. The bore 253*a* opens to the bore 252*a* of the collar 252 to allow insertion of one end of the band into one collar until the ferrule contacts the reduced diameter opening 253*b*. It can be appreciated that the ferrule at the opposite end of the band is added after the opposite end is extended into the bore 253*a* of the opposite collar. The ferrule can be affixed to the elastic band in a conventional manner so that the ferrule does not dislodge from the band when the band is under tension.

Figure 14:
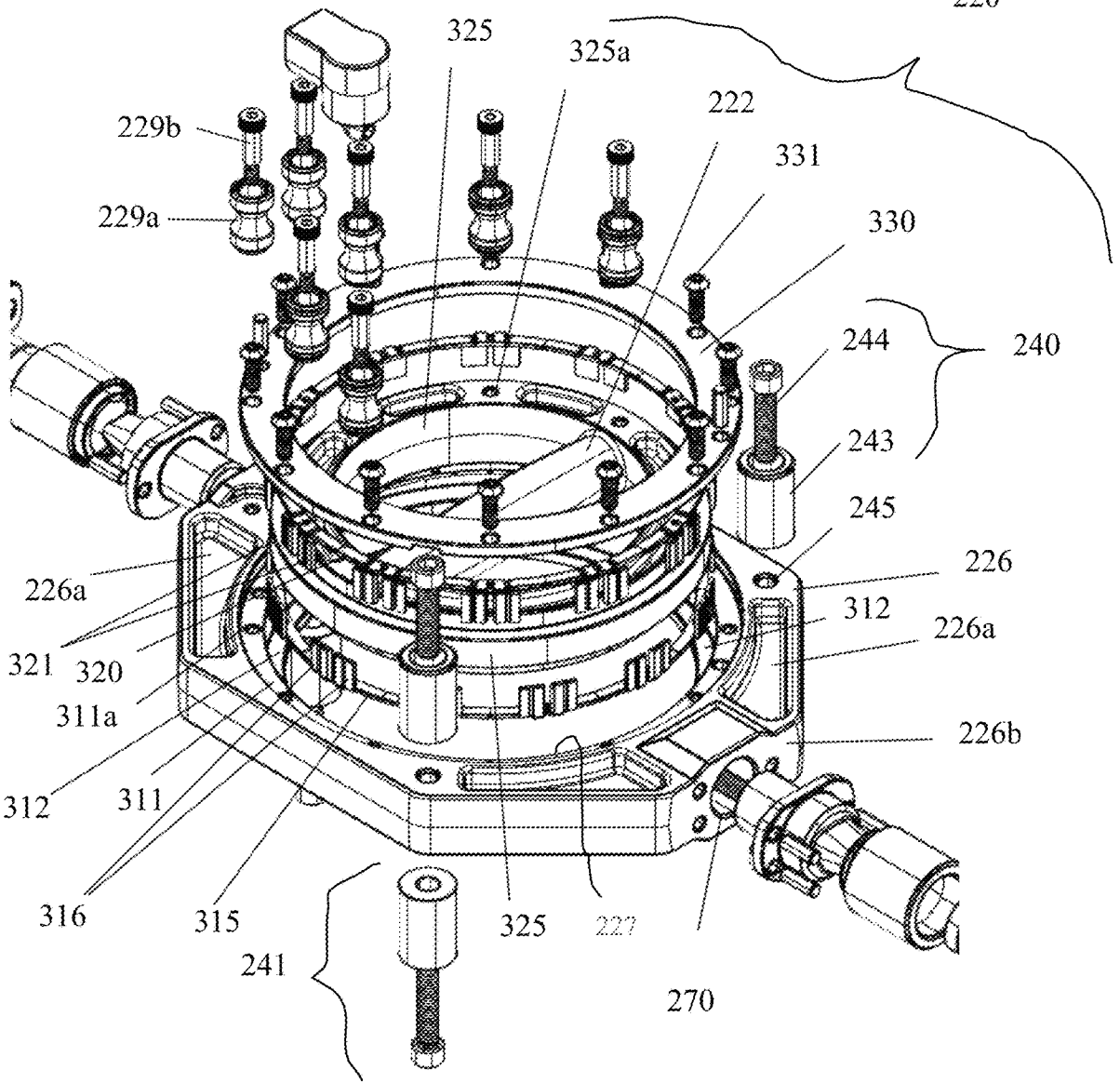
FIG. 14 is an exploded view of the grip assembly of the exercise bar assembly shown in FIG. 10.

Details of the grip assembly 220 are shown in FIG. 14. The frame 226 defines an annular mounting flange 311 and an annular bearing support flange 312 on the inner circumferential face of the frame. The bearing support flange 312 supports a lower bearing ring 315 that includes upward extending bearing bars 316. The lower bearing ring, and particularly the bearing bars, is formed of a low-friction material, such as a plastic. The bearing bars 316 are spaced around the circumference of the ring to mesh or interdigitate with bearing bars 321 projecting downward on an upper bearing ring 320. In one embodiment, twelve bearing bars are provided on each bearing ring, spaced at 30° intervals and spanning 30° of the circumference of each bearing ring. In particular, the bearing rings 315, 320 are identically constructed so that the rings are interchangeable when assembling the rotating grip assemblies. When the grip assembly is completed, the two sets of interdigitated bearing bars 316, 321 encircle the ring plate 325 and provide a substantially continuous circumferential bearing surface for relative rotation between the ring plate 325 and the interdigitated bearing rings 315, 320. In particular, the ring plate 325 is encased between the two meshed bearing rings 315, 210 with the outer circumferential surface of the bearing ring in sliding contact with the bearing surface formed by the bars 316, 321. The ring plate 325 includes the hand grip 222 and threaded bores 325*a* for mounting the bearing posts 228*a-e* for rotation with the ring plate. The ring plate 325 and the meshed lower and upper bearing tings 315, 320 are encased and held within the frame 226 by a bearing cap 330. Mounting bolts 331 pass through the bearing cap and are threaded into bores 311*a* of the annular mounting flange 311 to complete the assembly. It is contemplated that the ring plate 325 rotates smoothly within lower and upper bearing rings 315, 320 of the grip assembly 220. The lower and upper bearing rings can also rotate between the annular bearing flange 312 and the bearing cap 330 to ensure a smooth rotation of the ring plate during use.

Figure 16:
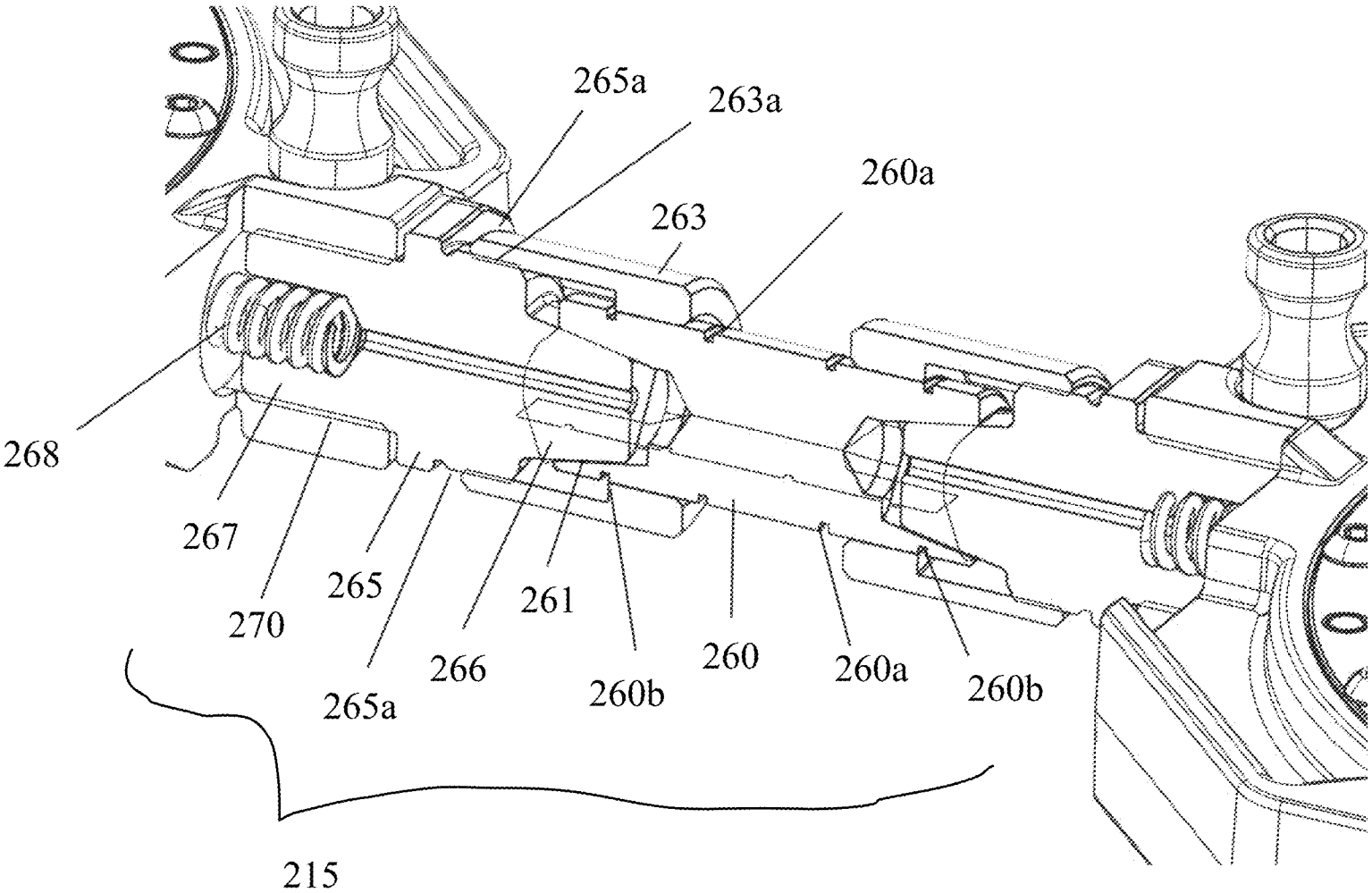
FIG. 16 is a side partial cross-sectional view of the center bar assembly shown in FIG. 15.

Details of the center bar assembly 215 are shown in FIGS. 15-16. The assembly includes a center bar 260 that includes a pair of inner snap ring grooves 260*a* and a pair of outer snap ring grooves 260*b* defined at opposite ends of the center bar. The snap ring grooves receive snap rings to capture a connecting collar 263 at each end of the center bar. The connecting collar includes internal threads 263*a* for threaded engagement with outer threads 265*a* of a mounting element 265. The mounting element 265 includes a tapered post 266 configured to be received within a tapered recess 261 of the center bar 260. The mating tapered components 266, 261 prevent rotation of the center bar 260 when it is fastened to the mounting elements by the corresponding connecting collar 263. The mounting elements 265 include a mounting flange 265*a* that is fastened to the planar frame 226 by fasteners 265*b*. In one aspect, the mounting element 265 can include a threaded post 267 that threads into a bore 270 in the frame 226 (FIG. 14). A pressure spring 268 can be embedded between the threaded post 267 and the frame 226. The mounting elements 265 (FIG. 16) are threaded into the bores 270 of the frames 226 of the two grip assemblies 220, and then anchored at the mounting flange 265*a* by the fasteners 265*b*. The connecting collars 263 are threaded onto the mounting element 265 to gradually press the tapered post 266 into the tapered recess 261 at the ends of the center bar 260, to firmly fasten the center bar assembly 215 together. As shown in FIG. 15, a cable ring 280 can be mounted on the center bar 260, held in position by snap rings in the grooves 260*a*. The cable ring can be used to fasten to a cable of a pulley-based exercise machine, such as a Smith machine.

Figure 17:
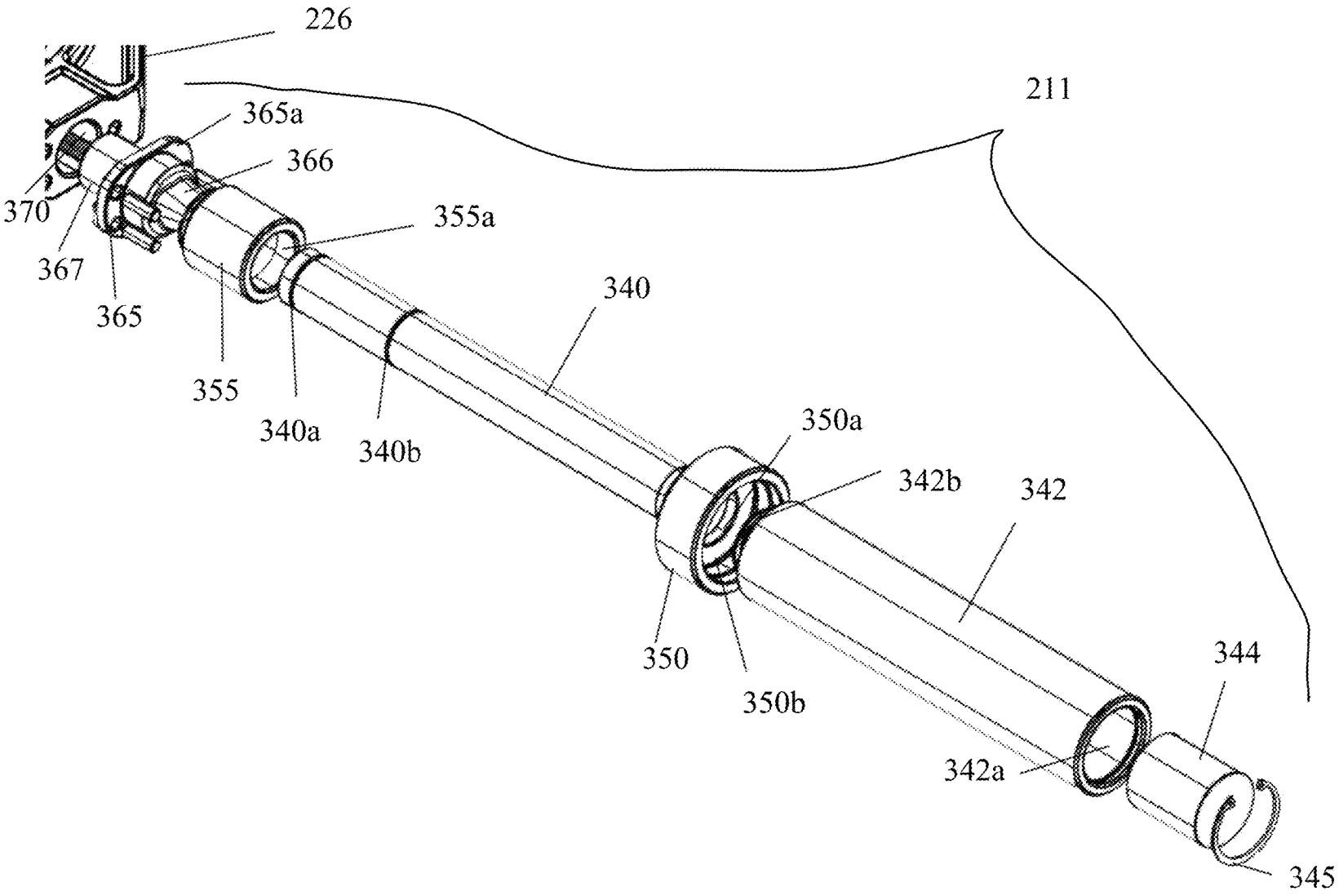
FIG. 17 is an exploded view of the plate bar assembly of the exercise bar assembly shown in FIG. 10.

The plate bar assemblies 211 are shown in FIG. 17. The assemblies are similar to the plate bar assemblies 11, including an inner bar 340 with snap ring grooves 340*a*, 340*b* adjacent the end of the bar connected to the frame 226 of the grip assembly 220. The snap ring groove 340*a* receives a snap ring to hold a mounting collar 355 on the end of the inner bar 340. The end of the inner bar includes a tapered recess (not shown), which is the same as the tapered recess 261 of the center bar 260. The tapered recess receives the tapered post 366 of the mounting element 365, which is configured the same as the mounting element 265. The mounting element 365 thus includes a post 367 that is seated within a bore 370 in the planar frame 226, and a mounting flange 365*a* that is fixed to the frame by fasteners. The inner bar 340 is thus held against rotation relative to the frame 226 and grip assemblies 220.

The second snap ring groove 340*b* captures a bearing collar 350, with the inner bar 340 extending through a bore 350*a* and the snap ring engaging the surface 350*b*. The plate bar assembly 211 further includes an outer bar 342 that is concentrically mounted for rotation on the inner bar 340. The outer bar 342 thus includes a center bore 342*a* sized to receive the inner bar. The end of the inner bar is seated against a thrust cap 344 that is held within the center bore 342*a* at the end of the outer bar 342 by a snap ring 345. The outer bar 342 includes a threaded end 342*b* that is configured to thread into the bore 350*a* of the bearing collar 350. The outer bar 342 is thus capable of rotating on the two bearing components 350, 344.

What is claimed is:

1. An exercise bar assembly comprising:

a pair of rotating grip assemblies, each including a generally planar frame, a ring plate supported within said planar frame for rotation in the plane of the frame, and a hand grip fastened to the ring plate for manual rotation of said ring plate relative to said frame;

a center bar assembly defining a longitudinal axis and opposite ends along the longitudinal axis, each of the opposite ends fastened to said frame of a corresponding one of the rotating grip assemblies along the longitudinal axis to separate the hand grips of the pair of rotating grip assemblies;

an elastic band engageable on said ring plate of each of said pair of rotating grip assemblies along said longitudinal axis, said elastic band resisting rotation of said ring plate in each of the rotating grip assemblies; and an elongated shield mounted to said center bar assembly, said elongated shield defining a channel along the length thereof, said elastic band disposed within said channel when said elastic band is engaged between said pair of rotating grip assemblies.

2. The exercise bar assembly of claim 1, wherein each of said rotating grip assemblies includes a pair of fixed bearing posts projecting perpendicularly from said frame and spaced apart to define a gap, said fixed bearing posts arranged on said frame so that said elastic band passes through said gap when it is engaged to the pair of rotating grip assemblies and so that said elastic band contacts a respective one of said fixed bearing posts upon rotation of said hand grip in the clockwise or counter-clockwise directions.

3. The exercise bar assembly of claim 1, wherein:

each of said pair of rotating grip assemblies includes a first bearing post projecting perpendicularly from said ring plate, said first bearing post arranged on said ring plate to be aligned with said longitudinal axis when said hand grip is perpendicular to said longitudinal axis; and said ring plate is rotatably mounted in said frame for rotation within the plane of the frame at least between a position in which said hand grip is perpendicular to said longitudinal axis and a position in which said hand grip is aligned with said longitudinal axis.

4. The exercise bar assembly of claim 3, wherein each of said pair of rotating grip assemblies includes one or more additional bearing posts projecting perpendicularly from said ring plate and spaced angularly apart from said first bearing post around the circumference of said ring plate so that said one or more additional bearing posts are successively engaged by said elongated band mounted on said first bearing post, when said ring plate of each of said rotating grip assemblies is rotated.

5. The exercise bar assembly of claim 4, wherein said one or more additional bearing posts are spaced apart at 45-degree intervals around the circumference of said ring plate from said first bearing post.

6. The exercise bar assembly of claim 4, wherein said one or more additional bearing posts include two bearing posts spaced apart from said first bearing post at 45-degree intervals clockwise around the circumference of said ring plate, and two bearing posts spaced apart from said first bearing post at 45-degree intervals counter-clockwise around the circumference of said ring plate.

7. The exercise bar assembly of claim 4, wherein said elastic band is engaged at each end thereof to a respective collar, each collar configured to be mounted on said first bearing post and said additional bearing posts of each of said pair of rotating grip assemblies.

8. An exercise bar assembly comprising:

a pair of rotating grip assemblies, each including a generally planar frame, a ring plate supported within said planar frame for rotation in the plane of the frame, a hand grip fastened to the ring plate for manual rotation of said ring plate relative to said frame, and a plurality of bearing posts projecting perpendicularly from said ring plate and spaced angularly apart around the circumference of said ring plate;

a center bar assembly defining a longitudinal axis and opposite ends along the longitudinal axis, each of the opposite ends fastened to said frame of a corresponding one of the rotating grip assemblies along the longitudinal axis to separate the hand grips of the pair of rotating grip assemblies; and an elastic band engageable on said ring plate of each of said pair of rotating grip assemblies along said longitudinal axis, said elastic band resisting rotation of said ring plate in each of the rotating grip assemblies, wherein;

each of said plurality of bearing posts includes a spool rotatably mounted to the ring plate of the corresponding one of the rotating grip assemblies said spool defining a circumferential groove; and said elastic band is engaged at each end thereof to a respective collar, said collar defining a bore sized to receive said spool therethrough and a bulge defined in said bore opening that is configured to conform to the circumferential groove of the spool and is configured so that the collar can be pushed down onto the spool until the bulge is engaged within the circumferential groove.

9. The exercise bar assembly of claim 8, wherein:

each collar includes a transverse bore intersecting said bore, said transverse bore having a reduced diameter opening; and said elastic band is sized to pass through said reduced diameter opening and includes a ferrule at each end thereof that has a diameter larger than said reduced diameter opening so that said ferrule cannot pass through said reduced diameter opening.

10. The exercise bar assembly of claim 9, further comprising a cap mountable on said collar to cover said bore.

11. An exercise bar assembly comprising:

a pair of rotating grip assemblies, each including a generally planar frame defining a circular opening, a ring plate supported within said circular opening planar frame for rotation in the plane of the frame, a hand grip fastened to the ring plate for manual rotation of said ring plate relative to said frame, and a plurality of bearing posts projecting perpendicularly from said ring plate and spaced angularly apart around the circumference of said ring plate;

a center bar assembly defining a longitudinal axis and opposite ends along the longitudinal axis, each of the opposite ends fastened to said frame of a corresponding one of the rotating grip assemblies along the longitudinal axis to separate the hand grips of the pair of rotating grip assemblies; and an elastic band engageable on said ring plate of each of said pair of rotating grip assemblies along said longitudinal axis, said elastic band resisting rotation of said ring late in each of the rotating grip assemblies, wherein said plurality of bearing posts each include a spool rotatably mounted to said ring plate of the corresponding rotating grip assembly, wherein said frame defines an annular mounting flange and a concentric annular bearing support flange in said circular opening, and wherein each of said rotating grip assemblies includes;

a lower bearing ring sized to be rotatably seated on said annular bearing flange, said lower bearing ring including a plurality of bearing bars projecting upward from said lower bearing ring and spaced apart around the circumference of said lower bearing ring;

an upper bearing ring including a plurality of bearing bars projecting downward from said upper bearing ring and spaced apart around the circumference of said upper bearing ring, said ring plate disposed between said lower bearing ring and said upper bearing ring, said plurality of bearing bars of the lower bearing ring juxtaposed with said bearing bars of said upper bearing ring to define a substantially continuous circumferential bearing surface in contact with said ring plate; and a bearing cap fastened to said annular mounting flange and encasing said ring plate, said lower bearing ring and said upper bearing ring within said frame.

12. The exercise bar assembly of claim 11, wherein said lower bearing ring and said upper bearing ring are identically configured and interchangeable in each of said pair of rotating grip assemblies.

13. The exercise bar assembly of claim 12, wherein said bearing bars span 30° (thirty degrees) of the circumference of the respective lower and upper bearing ring and are spaced apart by 30° (thirty degrees) around the circumference thereof.

14. The exercise bar assembly of claim 11, wherein at least said bearing bars are formed of a low friction plastic material.

15. The exercise bar assembly of claim 11, further comprising a pair of plate bar assemblies fastened to said frame of a corresponding one of said rotating grip assemblies along said longitudinal axis, wherein each of said plate bar assemblies is configured to receive and support a number of weight plates.

16. The exercise bar assembly of claim 15, wherein each of said plate bar assemblies is removably fastened to said frame of said pair of rotating grip assemblies.

* * * * *